US008696973B2

(12) United States Patent
Ishikawa et al.

(10) Patent No.: US 8,696,973 B2
(45) Date of Patent: Apr. 15, 2014

(54) NANOFIBER MANUFACTURING APPARATUS AND METHOD OF MANUFACTURING NANOFIBERS

(75) Inventors: Kazunori Ishikawa, Osaka (JP); Takahiro Kurokawa, Osaka (JP); Hiroto Sumida, Nara (JP)

(73) Assignee: Panasonic Corporation, Osaka (JP)

( * ) Notice: Subject to any disclaimer, the term of this patent is extended or adjusted under 35 U.S.C. 154(b) by 237 days.

(21) Appl. No.: 13/260,824

(22) PCT Filed: Oct. 27, 2010

(86) PCT No.: PCT/JP2010/006338

§ 371 (c)(1),
(2), (4) Date: Sep. 28, 2011

(87) PCT Pub. No.: WO2011/058708

PCT Pub. Date: May 19, 2011

(65) Prior Publication Data

US 2012/0025429 A1 Feb. 2, 2012

(30) Foreign Application Priority Data

Nov. 10, 2009 (JP) ..... 2009-257529
Mar. 11, 2010 (JP) ..... 2010-054736

(51) Int. Cl.
*D06M 10/00* (2006.01)
*H05B 6/00* (2006.01)
*G06F 7/66* (2006.01)

(52) U.S. Cl.
USPC ..... 264/465; 264/40.1; 700/196

(58) Field of Classification Search
USPC ..... 264/10, 40.1, 40.7, 406, 408, 412, 464, 264/465, 466, 484
See application file for complete search history.

(56) References Cited

U.S. PATENT DOCUMENTS 4,762,975 A * 8/1988 Mahoney et al. ..... 264/10 X
2002/0122840 A1 9/2002 Lee et al.
2010/0008994 A1* 1/2010 Reneker et al. ..... 264/466 X

FOREIGN PATENT DOCUMENTS

JP 2002-201559 7/2002

OTHER PUBLICATIONS

International Search Report issued Feb. 8, 2011 in International (PCT) Application No. PCT/JP2010/006338.

* cited by examiner

*Primary Examiner* — Leo B Tentoni
(74) *Attorney, Agent, or Firm* — Wenderoth, Lind & Ponack, L.L.P.

(57) ABSTRACT

A method of manufacturing nanofibers according to an aspect of the present invention by electrically stretching a solution in space and depositing the nanofibers in a given region includes: effusing the solution from an effusing body having an effusing hole which allows the solution to effuse in a direction; applying a given voltage between the effusing body and a charging electrode being conductive and disposed at a given distance from the effusing body, using a charging power supply configured to apply the given voltage; and determining a flight path of the solution and the nanofibers such that a length of the flight path of the solution and the nanofibers is longer than a shortest path length which is a length of a shortest imaginary path connecting an end opening of the effusing hole and an accumulation part on which the nanofibers are accumulated.

1 Claim, 13 Drawing Sheets

NANOFIBER MANUFACTURING APPARATUS AND METHOD OF MANUFACTURING NANOFIBERS

BACKGROUND OF THE INVENTION

The present invention relates to a nanofiber manufacturing apparatus which produces fibers having diameters of submicron order or nanometer order (referred to as nanofibers in this description) by electrostatic stretching, and a method of manufacturing nanofibers.

There is a known method of manufacturing filamentous (fibrous) substances containing a resin and having a submicron- or nanometer-scale diameter by making use of electrostatic stretching (electrospinning).

The electrostatic stretching is a method of manufacturing nanofibers. In the method, a solution prepared by dispersing or dissolving a solute such as a resin in a solvent is effused (ejected) into space through a nozzle or the like, and the solution is charged and electrically stretched in flight so that nanofibers are produced.

The following describes the electrostatic stretching more specifically. The solvent gradually evaporates from the charged solution while the solution effused into space is in flight. The volume of the solution in flight thus gradually decreases while the charges imparted to the solution stay in the solution. As a result, the charge density of the solution in flight gradually increases. The solvent continuously evaporates and the charge density of the solution further increases, and the solution is explosively stretched into a line when the Coulomb force generated in the solution and repulsive to the surface tension of the solution surpasses the surface tension. This is how the electrostatic stretching occurs. The electrostatic stretching exponentially occurs in space consecutively so that nanofibers having diameters of sub-micron orders or nanometer orders are produced.

In order to manufacture nanofibers by the electrostatic stretching, an apparatus as disclosed in Japanese Unexamined Patent Application Publication Number 2002-201559 is used which includes a nozzle through which a solution is effused into space and an electrode disposed apart from the nozzle. A high voltage is applied between the nozzle and the electrode. The amount of charges of the solution depends on the distance between the nozzle and the electrode and the voltage applied. The amount of evaporation of the solvent contained in the solution depends on the distance between the nozzle and the electrode.

BRIEF SUMMARY OF THE INVENTION

Different solvents may be used for different nanofibers to be manufactured, that is, different solutes to be contained in solutions. In addition, a solvent may evaporate in different ways depending on ambient temperature and humidity. This means that it may be impossible to manufacture favorable nanofibers from a solution or in a manufacturing environment because of insufficient electrostatic stretching when the solution reaches an electrode before a solvent thereof sufficiently evaporates.

One possible way to solve the problem is to extend the distance between the nozzle and the electrode, that is, the flight distance of the solution in order to secure sufficient time for solvent evaporation. In this case, the voltage to be applied between the nozzle and the electrode needs to be increased accordingly for the extended distance therebetween in order to sufficiently charge the solution to produce favorable nanofibers. In addition, the apparatus needs to be highly insulated for application of such a high voltage. The size of the apparatus is also increased for the extension of the distance between the nozzle and the electrode.

The present invention, conceived to address the problem, has an object of providing a nanofiber manufacturing apparatus and a method for manufacturing nanofibers with which favorable nanofibers are securely produced by controlling the amount of solvent evaporation from a solution, while the distance between an electrode and an effusing body between which a high voltage is applied is kept constant. The effusing body may be a nozzle through which the solution is effused.

In order to achieve the object, the nanofiber manufacturing apparatus according to an aspect of the present invention, which produces nanofibers by electrically stretching a solution in space and deposits the nanofibers in a given region, includes: an effusing body having an effusing hole which allows the solution to effuse in a given direction; a charging electrode which is conductive and is disposed at a given distance from the effusing body; a charging power supply configured to apply a given voltage between the effusing body and the charging electrode; and a determining unit configured to determine a flight path of the solution and the nanofibers such that a length of the flight path of the solution and the nanofibers is longer than a shortest path length which is a length of a shortest imaginary path connecting an end opening of the effusing hole and an accumulation part on which the nanofibers are accumulated.

Consequently, the distance between the effusing body and the charging electrode is kept constant, and sufficient solvent evaporation from the solution is secured by determining a flight path of the solution and the nanofibers to allow sufficient time for the solvent evaporation. In addition, the voltage applied between the effusing body and the charging electrode is kept constant in accordance with the constant distance between the effusing body and the charging electrode, so that favorable nanofibers can be produced using a compact apparatus without risks such as undesirable discharge.

Furthermore, in order to achieve the object, the method of manufacturing nanofibers according to an aspect of the present invention by electrically stretching a solution in space and depositing the nanofibers in a given region includes: effusing the solution from an effusing body having an effusing hole which allows the solution to effuse in a direction; applying a given voltage between the effusing body and a charging electrode being conductive and disposed at a given distance from the effusing body, using a charging power supply configured to apply the given voltage; and determining a flight path of the solution and the nanofibers such that a length of the flight path of the solution and the nanofibers is longer than a shortest path length which is a length of a shortest imaginary path connecting an end opening of the effusing hole and an accumulation part on which the nanofibers are accumulated.

According to the present invention, nanofibers of uniform quality can be manufactured from different solutions even with a constant distance between the effusing body and the charging electrode and a constant voltage applied. In addition, the quality of nanofibers made from the same type of solution can be homogenized by controlling the amount of solvent evaporation depending on the manufacturing environment for nanofibers.

DESCRIPTION OF EMBODIMENTS

The following describes a nanofiber manufacturing apparatus and a method of manufacturing nanofibers according to the present invention with reference to the drawings.

Embodiment 1

Figure 1:
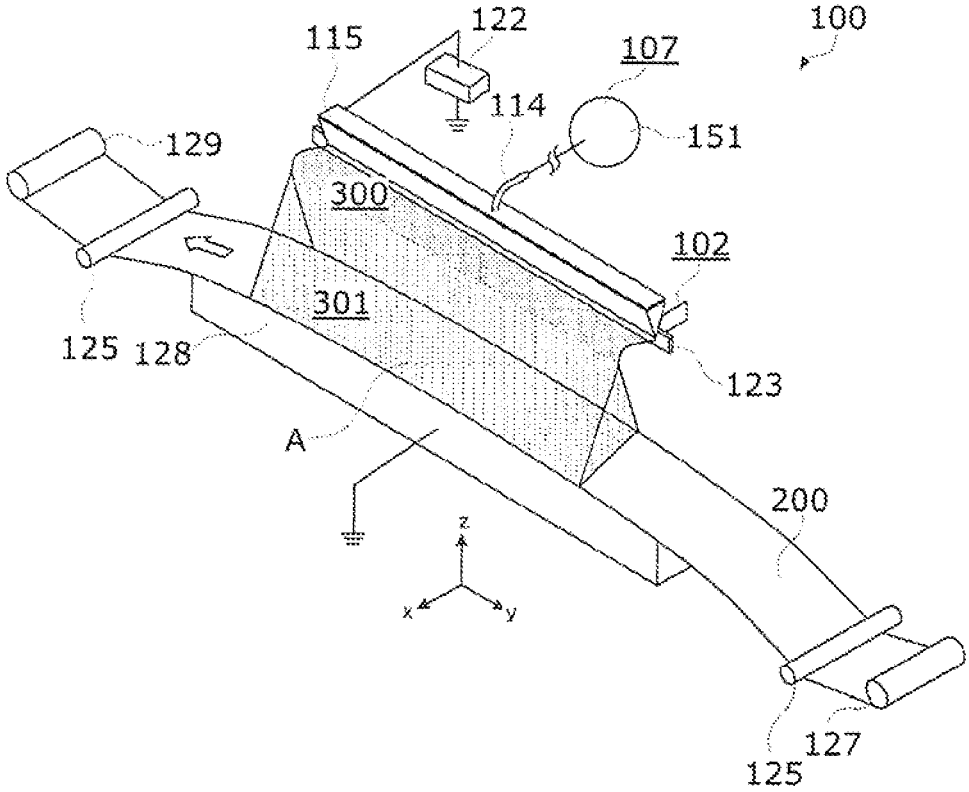
FIG. 1 is a perspective view illustrating a nanofiber manufacturing apparatus.

FIG. 1 is a perspective view illustrating a nanofiber manufacturing apparatus.

As shown in FIG. 1, a nanofiber manufacturing apparatus 100, which electrically stretches a solution 300 in space to produce nanofibers 301 and accumulate the nanofibers 301 to an accumulation part A, includes an effusing body 115, a charging electrode 128, a charging power supply 122, and a determining unit 102. Furthermore, in Embodiment 1, the nanofiber manufacturing apparatus 100 includes a deposition member 200 and a collection unit 129. The nanofibers 301 are deposited and accumulated onto the deposition member 200 provided to the accumulation part A, and the deposited nanofibers 301 are collected by the collection unit 129 together with the deposition member 200.

It is to be noted that the solution 300 and the nanofibers 301, which are separately referred to in the specification and the drawings, are not always distinguishable from each other because the solution 300 is gradually turned into the nanofibers 301 in the process of production of the nanofibers 301, that is, in electrostatic stretching.

Figure 2:
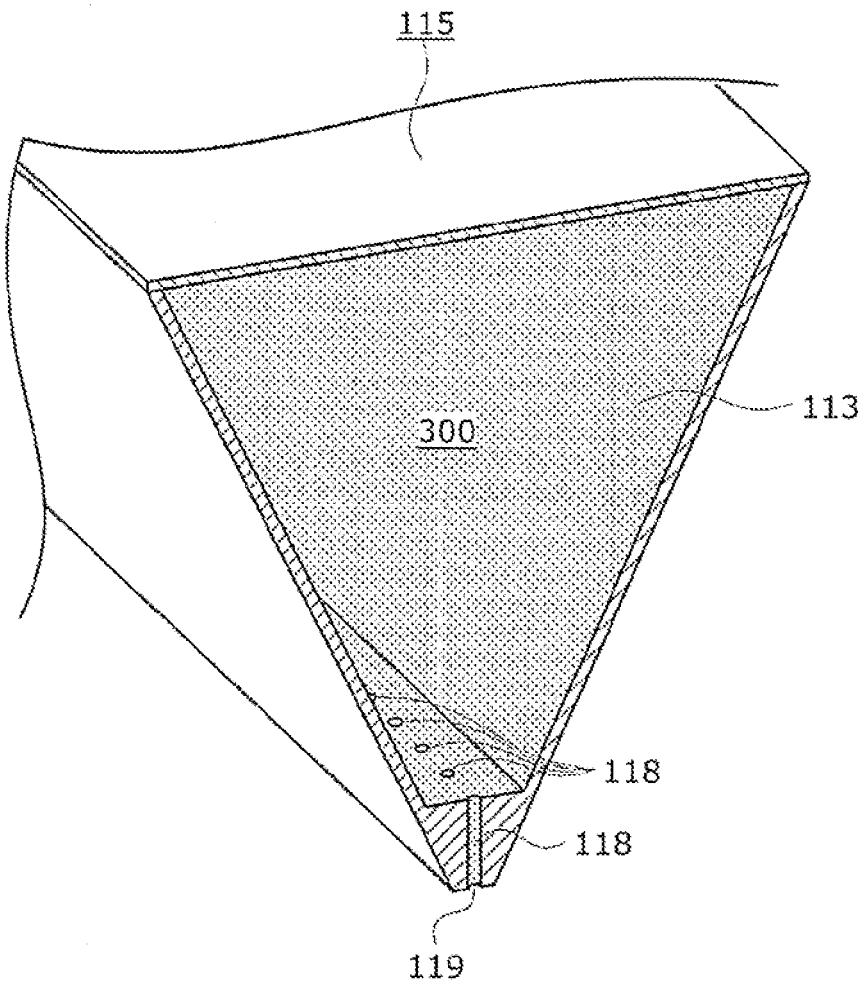
FIG. 2 is a perspective view illustrating a cutaway of the effusing body.

FIG. 2 is a perspective view illustrating a cutaway of the effusing body.

The effusing body 115 is a member for effusing the solution 300 into space by pressure of the solution 300 (and gravity in some cases). The effusing body 115 has effusing holes 118 and a storage tank 113. The effusing body 115 includes a conductive member on at least part of the surface in contact with the solution 300 so as to function as an electrode to provide charges to the solution 300 which effuses from the effusing body 115. In Embodiment 1, the effusing body 115 is made of metal in whole. The metal to be used as a material for the effusing body 115 is not limited to a specific type of metal and may be any conductive metal such as brass or stainless steel.

The effusing holes 118 are holes which allow the solution 300 to effuse therethrough in a given direction. In Embodiment 1, the effusing body 115 has a plurality of effusing holes 118. The effusing holes 118 are provided in an elongated, strip-shaped face of the effusing body 115 in a manner such that end openings 119 at the ends of the respective effusing holes 118 align. The effusing holes 118 are provided to the effusing body 115 such that the solution 300 effuses in the same direction with respect to the effusing body 115.

The effusing holes 118 do not have a specifically limited length or diameter and are formed to have a shape appropriate for conditions such as the viscosity of the solution 300. Specifically, the effusing holes 118 preferably have a length within a range from 1 mm to 5 mm and a diameter within a range from 0.1 mm to 2 mm. The shape of the effusing holes 118 is not limited to a cylindrical shape and any shape may be selected for the shape as necessary. In particular, the shape of the end openings 119 is not limited to a circular shape and may be a polygonal shape such as a triangle or a quadrilateral, and even a concave shape such as a star polygon.

It is to be noted that the effusing body 115 may move with respect to the charging electrode 128 as long as the solution 300 effuses through the effusing holes 118 in a given direction with respect to the charging electrode 128.

In addition, the nanofiber manufacturing apparatus 100 in Embodiment 1 includes a supply unit 107 as shown in FIG. 1. The supply unit 107 includes a container 151, a pump (not shown in the drawing), and a guide tube 114 to supply the solution 300 to the effusing body 115. The container 151 stores the solution 300 in a large quantity. The pump transfers the solution 300 with a given pressure. The guide tube guides the solution 300.

The charging electrode 128 is disposed at a given distance from the effusing body 115 as shown in FIG. 1. A high voltage is applied between the effusing body 115 and the charging electrode 128. The charging electrode 128 attracts the nanofibers 301 produced by the electrostatic stretching toward itself. In Embodiment 1, the charging electrode 128 is a blockish, conductive member having a gently curved surface protruding toward the effusing body 115 (in a z-axis direction). The charging electrode 128 in Embodiment 1 is grounded. The curve of the charging electrode 128 causes the deposition member 200 (described later) mounted on the charging electrode 128 to curve so as to protrude in a part where the nanofibers 301 are to be deposited. As a result, the deposition member 200 is prevented from warping due to shrinkage of the nanofibers 301 deposited on the deposition member 200. In addition, the charging electrode 128 in Embodiment 1 serves as a member included in the accumulation part A. The nanofibers 301 attracted by the charging electrode 128 are deposited on the deposition member 200 mounted on the charging electrode 128 so that the nanofibers 301 are accumulated.

The charging power supply 122 is a power supply capable of applying a high voltage between the effusing body 115 and the charging electrode 128. In Embodiment 1, the charging power supply 122 is a direct-current power supply and preferably applies a voltage within a range from 5 kV to 100 kV.

The charging electrode 128 is grounded by setting one of the electrodes of the charging power supply 122 at a ground potential as in Embodiment 1 even when the charging electrode 128 is relatively large, so that safety of the nanofiber manufacturing apparatus is improved.

The solution 300 may be charged by grounding the effusing body 115 and keeping the charging electrode 128 at a high voltage with a power supply connected to the charging electrode 128. The charging electrode 128 and the effusing body 115 are not necessarily grounded.

The charging electrode 128 may not be located at the accumulation part A. Specifically, the charging electrode 128 may be located outside of the accumulation part A (for example, at a location closer to the effusing body 115 than to the accumulation part A) and charge the solution 300 which effuses from the effusing body 115. In this case, the accumulation part A may include an attracting electrode only for attracting nanofibers by an electric field. Alternatively, the accumulation part A may not include an electrode and the nanofibers may be carried to the accumulation part A (the deposition member) by a gas flow.

The charging electrode 128 may have a flat surface instead of the curved surface.

The determining unit 102 is a member or a device which determines a flight path of the solution 300 and the nanofibers 301 such that a flight path length C (see FIG. 3) of the solution 300 and the nanofibers 301 is longer than a shortest path length B (see FIG. 3) which is the length of the shortest imaginary path connecting one of the end openings 119 of the effusing holes 118 and the accumulation part A.

In Embodiment 1, the shortest path length B is the length of the shortest imaginary path connecting any one of the end openings 119 of the effusing holes 118 and the charging electrode 128.

Figure 3:
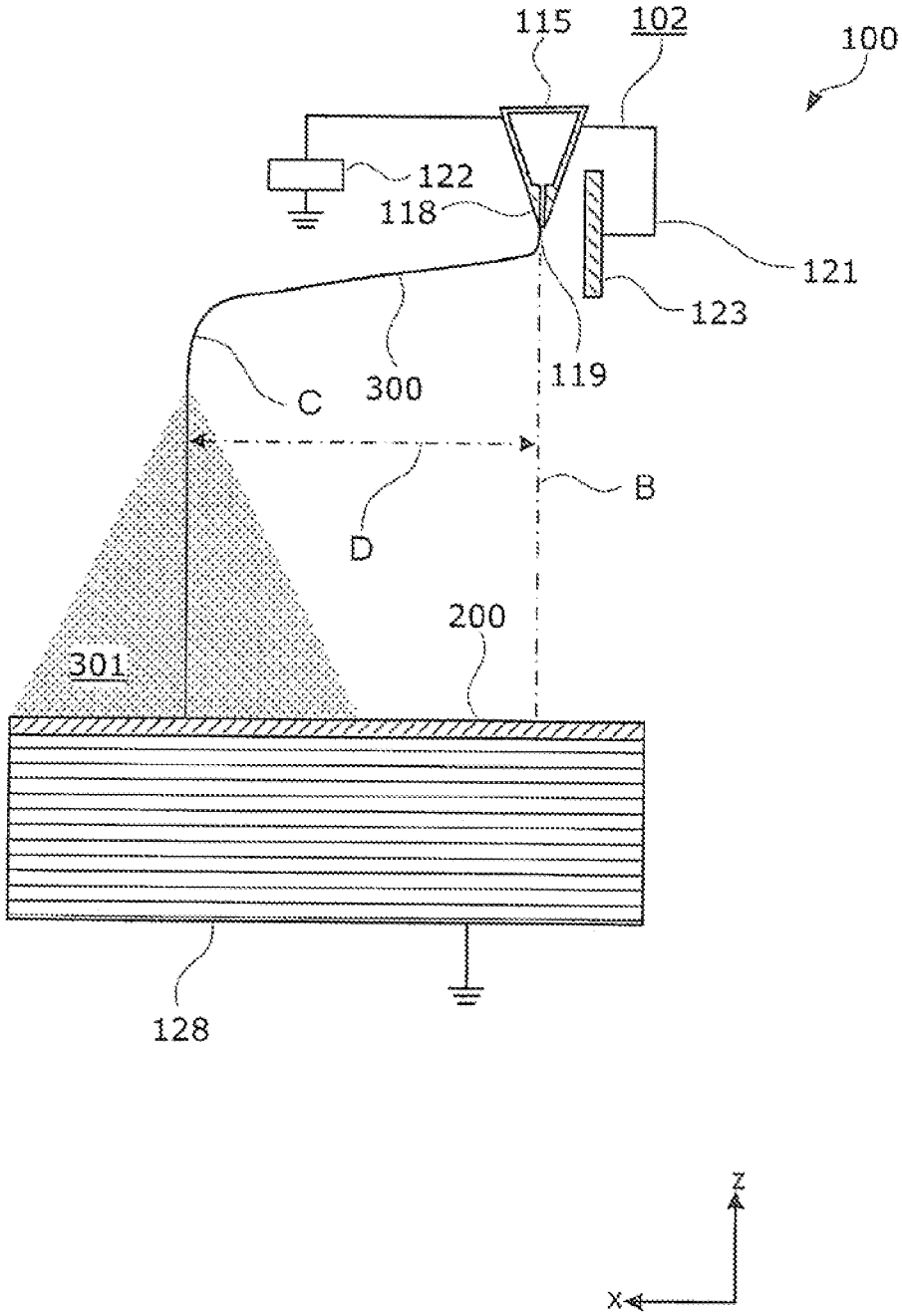
FIG. 3 is a side view illustrating a cross section of a main part of the nanofiber manufacturing apparatus.

FIG. 3 is a side view illustrating a cross section of a main part of the nanofiber manufacturing apparatus.

As shown in FIG. 3, the determining unit 102 in Embodiment 1 includes a determining electrode 123 and an applying unit 121.

The determining electrode 123 is a conductive member with a connection such that the determining electrode 123 is at the same potential as the effusing body 115. In Embodiment 1, the determining electrode 123 is disposed between the effusing body 115 and the charging electrode 128 and extends along an array of the end openings 119 of the effusing holes 118. Here, the space meant by the phrase of "between the effusing body 115 and the charging electrode 128" includes the space near the sides of the effusing body 115 or the sides of the charging electrode 128.

The determining electrode 123 is disposed at a position such that the determining electrode 123 electrically repels the solution 300 immediately after effusing from the effusing body 115 and afterward. For example, the determining electrode 123 is disposed at a position lateral to the effusing body 115 or a position relatively close to the effusing body 115 and lateral to the shortest path connecting the effusing body 115 and the accumulation part A.

The determining electrode 123 may function as the effusing body 115. Specifically, when two effusing bodies 115 are disposed very close to each other, one of the effusing bodies 115 functions as the determining electrode 123 for the other effusing body 115.

The applying unit 121 is a member or a device which applies a given potential to the determining electrode 123. In Embodiment 1, the applying unit 121 is a lead wire (such as a bus bar) electrically connecting the effusing body 115 and the determining electrode 123 so that the determining electrode 123 is set at the same potential as the effusing body 115.

The applying unit 121 may be provided with a power supply other than the charging power supply 122 and apply a given potential to the determining electrode 123 using the power supply. The determining electrode 123 is not necessarily set at the same potential as the effusing body 115 and any desired potential may be supplied to the determining electrode 123.

In the determining unit 102, the electric field between the effusing body 115 and the charging electrode 128 is affected by the determining electrode 123 at the same potential as the effusing body 115. The determining unit 102 makes a determination such that the solution 300 and the nanofibers 301 repel the determining electrode 123 and fly along a path to diverge from the determining electrode 123 so that the flight path length C of the solution 300 and the nanofibers 301 is longer than the shortest path length B by a set length D. This strictly describes a case where the solution 300 and the nanofibers 301 take a flight path including a horizontal flight of the set length D and a subsequent vertical fall of B. However, the solution 300 and the nanofibers 301 actually take a path along which the solution 300 and the nanofibers 301 obliquely descend while laterally moving for D, and then vertically fall after being displaced due to the effect of the determining unit 102 as shown in FIG. 3. Therefore, in a strict sense, the determining unit 102 determines the flight path length C such that the nanofibers 301 finally land on a point horizontally shifted, by the set length D, from a point on the accumulation part A to which the shortest path length B leads the nanofibers 301. The above determination includes the determination in this sense.

Thereby the time for evaporation of the solvent from the solution 300 is prolonged by the time corresponding to the set length D without changing the shortest path length B between the effusing body 115 and the charging electrode 128. As a result, the probability of occurrence of electrostatic stretching is increased and quality of nanofibers 301 can be improved.

Here, in Embodiment 1, in order to determine the flight path of the solution 300 and the nanofibers 301, a position changing unit for changing the position of the determining electrode 123 may be additionally provided. In addition, the shape or size of the determining electrode 123 may be changed. When the determining electrode 123 is connected with an additional power supply, the flight path may be changed by changing a voltage to be applied to the determining electrode 123.

The deposition member 200 is a sheet member rolled around a feed roll 127 when delivered. The deposition member 200 is rolled by the collection unit 129 and thereby moves in the direction indicated by the arrow in FIG. 1. The deposition member 200 is provided so as to follow the curve of the charging electrode 128 and is movably pressed downward by presser members 125. The presser members 125 have a bar shape and are disposed in the vicinity of both ends of the charging electrode 128.

The following describes a method of manufacturing the nanofibers 301 using the nanofiber manufacturing apparatus 100.

Figure 4:
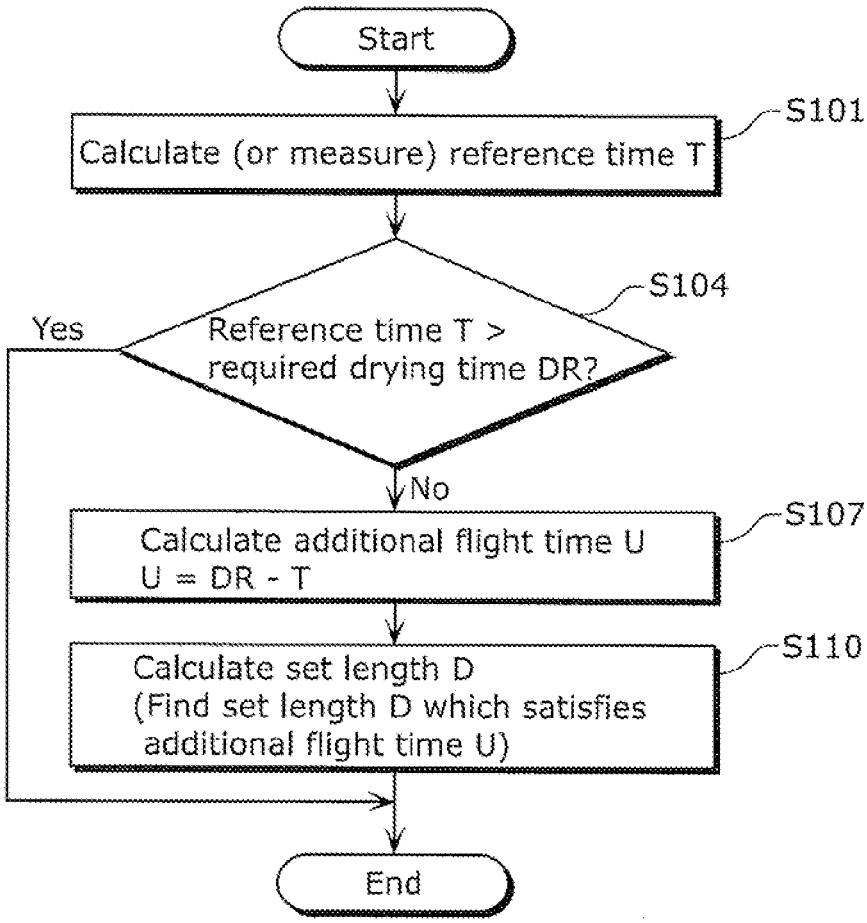
FIG. 4 shows a flowchart of a process of determining a set length D.

FIG. 4 shows a flowchart of a process of determining a set length D.

Referring to FIG. 4, a reference time T is calculated or measured (S101). The reference time T is a period of time from effusion of the solution 300 from the effusing body 115 until arrival of the nanofibers 301 derived from the solution 300 on the charging electrode 128 in the case where the determining unit 102 is not present or does not make a determination. In other words, the reference time T is a period of time in the case where the flight path length of the solution 300 and the nanofibers 301 is the shortest path length B.

Next, a comparison is made between the reference time T and a required drying time DR (S104). The required drying time DR is a period of time from the effusion of the solution 300 from the effusing body 115 until generation of favorable nanofibers 301 as a result of sufficient electrostatic stretching.

When the comparison shows that the reference time T is longer than the required drying time DR (Yes in 104), it is unnecessary to determine a flight path of the solution 300 and the nanofibers 301. Then, the determination process ends without performing a calculation to determine a set length D.

On the other hand, when the comparison shows that the reference time T is shorter than the required drying time DR (No in 104), the process proceeds to the next step.

Next, an additional flight time U is calculated. Specifically, the additional flight time U is calculated using an expression of U=DR−T (S107).

Next, a calculation is performed to determine a set length D which satisfies the additional flight time U (S110). Strictly, a calculation is performed to determine a set length D which is the amount of a horizontal shift of a point where the nanofibers 301 finally land such that the set length D satisfies the additional flight time U.

The set length D is thus calculated. Then, the determining unit 102 is adjusted according to the set length D calculated.

The set length D may be determined on the basis of a result of an experiment in which the determining electrode 123 is adjusted in position, shape, or size to determine a condition under which electrostatic stretching occurs after effusion of the solution 300 from the effusing body 115 sufficiently for production of favorable nanofibers 301. In addition, when the determining electrode 123 is connected with an additional power supply, the set length D may be determined on the basis of a result of an experiment in which a voltage to be applied to the determining electrode 123 is changed to determine a condition under which favorable nanofibers 301 are produced.

The nanofibers 301 are manufactured using the nanofiber manufacturing apparatus 100 adjusted in the manner as described above.

First, the supply unit 107 supplies the solution 300 to the effusing body 115 (a supply step). The storage tank 113 of the effusing body 115 is thus filled with the solution 300.

Here, the solute which is to be dissolved or dispersed in the solution 300 and is to be a resin contained in the nanofibers 301 is a high molecular substance. Examples of the high molecular substance include polypropylene, polyethylene, polystyrene, polyethylene oxide, polyethylene terephthalate, polybutylene terephthalate, polyethylene naphthalate, poly-m-phenylene terephthalate, poly-p-phenylene isophthalate, polyvinylidene fluoride, polyvinylidene fluoride-hexafluoropropylene copolymer, polyvinyl chloride, polyvinylidene chloride-acrylate copolymer, polyacrylonitrile, polyacrylonitrile-methacrylate copolymer, polycarbonate, polyarylate, polyester carbonate, polyamide, aramid, polyimide, polycaprolactone, polylactic acid, polyglycolic acid, collagen, polyhydroxybutyric acid, polyvinyl acetate, polypeptide, and a copolymer thereof. The solute may be the one selected from among the above substances or a mixture thereof. The substances are given for illustrative purposes only and the solute used in the present invention is not limited to the resins above.

The solvent to be used as the solution 300 may be a volatile organic solvent. Specific examples of the solvent include methanol, ethanol, 1-propanol, 2-propanol, hexafluoroisopropanol, tetraethylene glycol, triethylene glycol, dibenzyl alcohol, 1,3-dioxolane, 1,4-dioxane, methyl ethyl ketone, methyl isobutyl ketone, methyl-n-hexyl ketone, methyl-n-propyl ketone, diisopropyl ketone, diisobutyl ketone, acetone, hexafluoroacetone, phenol, formic acid, methyl formate, ethyl formate, propyl formate, methyl benzoate, ethyl benzoate, propyl benzoate, methyl acetate, ethyl acetate, propyl acetate, dimethyl phthalate, diethyl phthalate, dipropyl phthalate, methyl chloride, ethyl chloride, methylene chloride, chloroform, o-chlorotoluene, p-chlorotoluene, chloroform, carbon tetrachloride, 1,1-dichloroethane, 1,2-dichloroethane, trichloroethane, dichloropropane, dibromoethane, dibromopropane, methyl bromide, ethyl bromide, propyl bromide, acetic acid, benzene, toluene, hexane, cyclohexane, cyclohexanone, cyclopentane, o-xylene, p-xylene, m-xylene, acetonitrile, tetrahydrofuran, N,N-dimethylformamide, N,N-dimethylacetamide, dimethyl sulfoxid, pyridine, and water. The solvent may be the one selected from among the above substances or a mixture thereof. The substances are given for illustrative purposes only and the solvent used in the present invention is not limited to the solvents above.

In addition, an additive of an inorganic solid material may be added to the solution 300. The inorganic solid material may be an oxide, a carbide, a nitride, a boride, a silicide, a fluoride, or a sulfide. However, in view of preferable properties, such as thermal resistance and workability, of the nanofibers 301 to be manufactured, an oxide is preferable among them. Examples of the additive include $Al_2O_3$, $SiO_2$, $TiO_2$, $Li_2O$, $Na_2O$, MgO, CaO, SrO, BaO, $B_2O_3$, $P_2O_5$, $SnO_2$, $ZrO_2$, $K_2O$, $Cs_2O$, ZnO, $Sb_2O_3$, $As_2O_3$, $CeO_2$, $V_2O_5$, $Cr_2O_3$, MnO, $Fe_2O_3$, CoO, NiO, $Y_2O_3$, $Lu_2O_3$, $Yb_2O_3$, $HfO_2$, and $Nb_2O_5$. The oxide may be the one selected from among the above substances or a mixture thereof. The substances are given for illustrative purpose only and the additive to be added to the solution 300 in the present invention is not limited to the substances above.

The mixture ratio between the solvent and the solute in the solution 300 depends on the selected solvent and the selected solute. A desirable amount of solvent accounts for approximately 60 to 98 weight percent. A preferable amount of solute accounts for 5 to 30 weight percent.

Next, the charging power supply 122 sets the effusing body 115 at a positive or negative high voltage. Then, charges concentrate at the end openings 119 in the effusing body 115 facing the charging electrode 128, which is grounded, and the charges transfer to the solution 300 which effuses through the effusing holes 118 into space, so that the solution 300 is charged (a charging step).

The charging step and the supply step are simultaneously performed so that the solution 300 charged effuses from the end openings 119 of the effusing body 115 (an effusing step).

A flight path of the solution 300 and the nanofibers 301 effused from the effusing body 115 is determined by the determining unit 102 such that the flight path length C of the solution 300 and the nanofibers 301 is longer than the shortest path length B, which is the length of the shortest imaginary line connecting the end openings 119 of the effusing holes 118 and the accumulation part A (the charging electrode 128), by the set length D (a determining step).

Next, the solution 300 flying in space for a certain distance is electrostatically stretched so that the nanofibers 301 are produced (a nanofiber producing step). Here, the solution 300 flying out of the effusing holes 118 forms thin threads without uniting each other in flight. Most of the solution 300 thus turns to the nanofibers 301. The distance between the end openings 119 of the effusing holes 118 and the charging electrode 128 keeps the shortest path length B, and it is thus possible to effuse the solution 300 which is highly charged (that is, at a high charge density). On the other hand, because the flight path length C along which the solution 300 and the nanofibers 301 fly is longer than the shortest path length B, electrostatic stretching repeatedly occurs so that favorable nanofibers 301 having a thin diameter are generated in a large quantity.

In this condition, the nanofibers 301 fly toward the deposition member 200 along an electric field generated between the effusing body 115 and the charging electrode 128 to be deposited on the accumulation part A of the deposition member 200 where the nanofibers 301 are accumulated (a depositing step). The deposition member 200 is slowly transferred by the collection unit 129 so that each of the nanofibers 301 deposited on the deposition member 200 has a band-like shape extending in the direction of the transfer.

The nanofiber manufacturing apparatus 100 configured in the manner as described above is compact and capable of causing sufficient electrostatic stretching such that favorable nanofibers 301 are produced. In addition, changing the determining electrode 123 in properties such as position, shape, or size allows the apparatus 100 to handle various solutions 300.

The following describes another embodiment of the determining unit 102.

Figure 5:
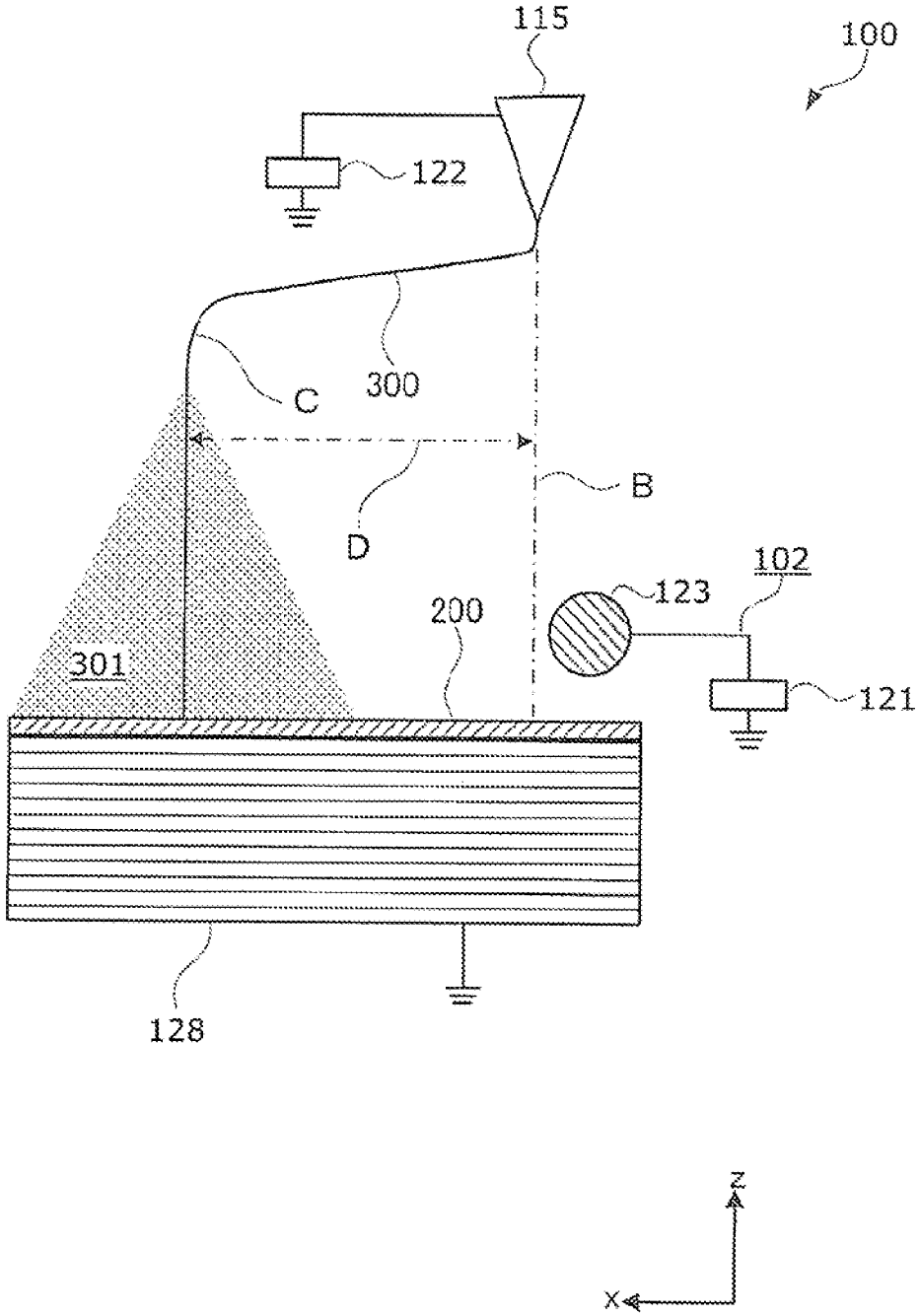
FIG. 5 is a side view illustrating a cross section of a main part of a nanofiber manufacturing apparatus to show another determining unit.

FIG. 5 is a side view illustrating a cross section of a main part of a nanofiber manufacturing apparatus to show another determining unit.

As shown in FIG. 5, a determining unit 102 includes a determining electrode 123 and an applying unit 121.

The determining electrode 123 is a metallic round bar extending in the direction of the array of the effusing holes 118 and disposed to be closer to a charging electrode than to the effusing body 115. Such a round-bar shape makes it difficult for discharge to occur between the charging electrode 128 and the determining electrode 123 close to the charging electrode 128.

The applying unit 121 is a direct-current power supply which applies a given potential to the determining electrode 123.

The determining unit 102 in this embodiment allows change of the set length D as necessary by changing the potential of the determining electrode 123 using the applying unit 121. It is to be noted that the determining electrode 123, which may be different in position, size, or shape in this embodiment, also produces the same advantageous effect, which is within the present invention.

Figure 6:
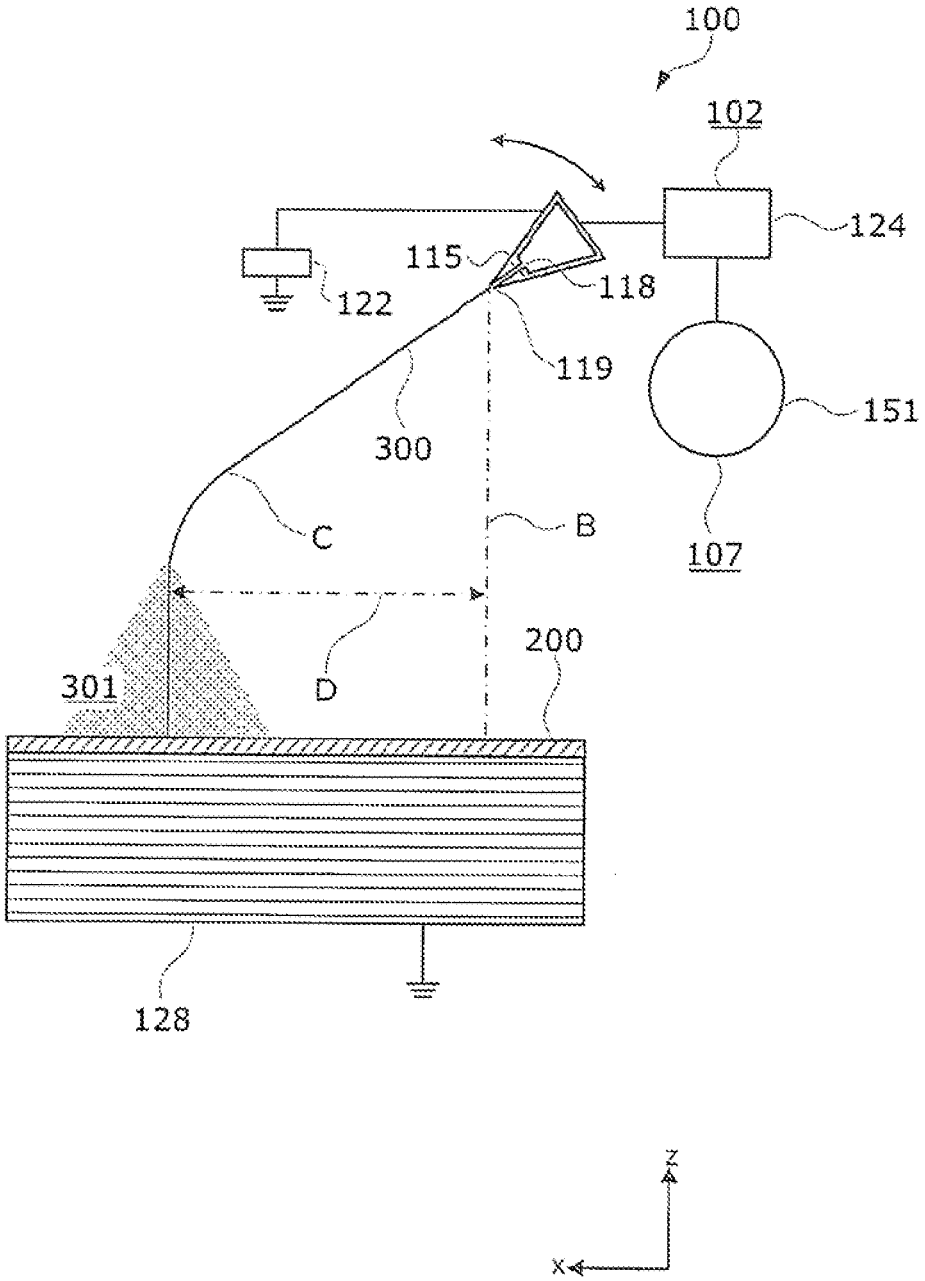
FIG. 6 is a side view illustrating a cross section of a main part of a nanofiber manufacturing apparatus to show another determining unit.

FIG. 6 is a side view illustrating a cross section of a main part of a nanofiber manufacturing apparatus to show another determining unit.

The effusing holes 118 of the effusing body 115 are provided in a manner such that the solution effuses through the effusing holes 118 in a given direction crossing the shortest imaginary line connecting the end openings 119 of the effusing holes 118 and the charging electrode 128 (the shortest path length B).

The determining unit 102 includes a pressurizing unit 124 which determines a pressure of the solution 300 to effuse through the effusing holes 118. Specifically, the pressurizing unit 124 is a liquid pump capable of pumping the solution 300 at a given pressure.

In this configuration, the set pressure of the pressurizing unit 124 provides the solution 300 with an initial velocity to cause the solution 300 to fly against the gravity or attraction of an electric field generated between the effusing body 115 and the charging electrode 128. In addition, the flight path of the solution 300 and the nanofibers 301 can be determined by changing the set pressure of the pressurizing unit 124. Thereby the time for evaporation of the solvent from the solution 300 is prolonged by the time corresponding to the set length D without changing the shortest path length B between the effusing body 115 and the charging electrode 128. As a result, the probability of occurrence of electrostatic stretching is increased and quality of nanofibers 301 can be improved.

It is to be noted that the determining unit 102 may include a tilting unit for tilting the effusing body 115 in the directions of the arrows in FIG. 6. The titling unit also enables determination of the flight path of the solution 300 and the nanofibers 301, and the flight path can be more finely tuned when the tilting unit is used in combination with the pressurizing unit 124.

Figure 7:
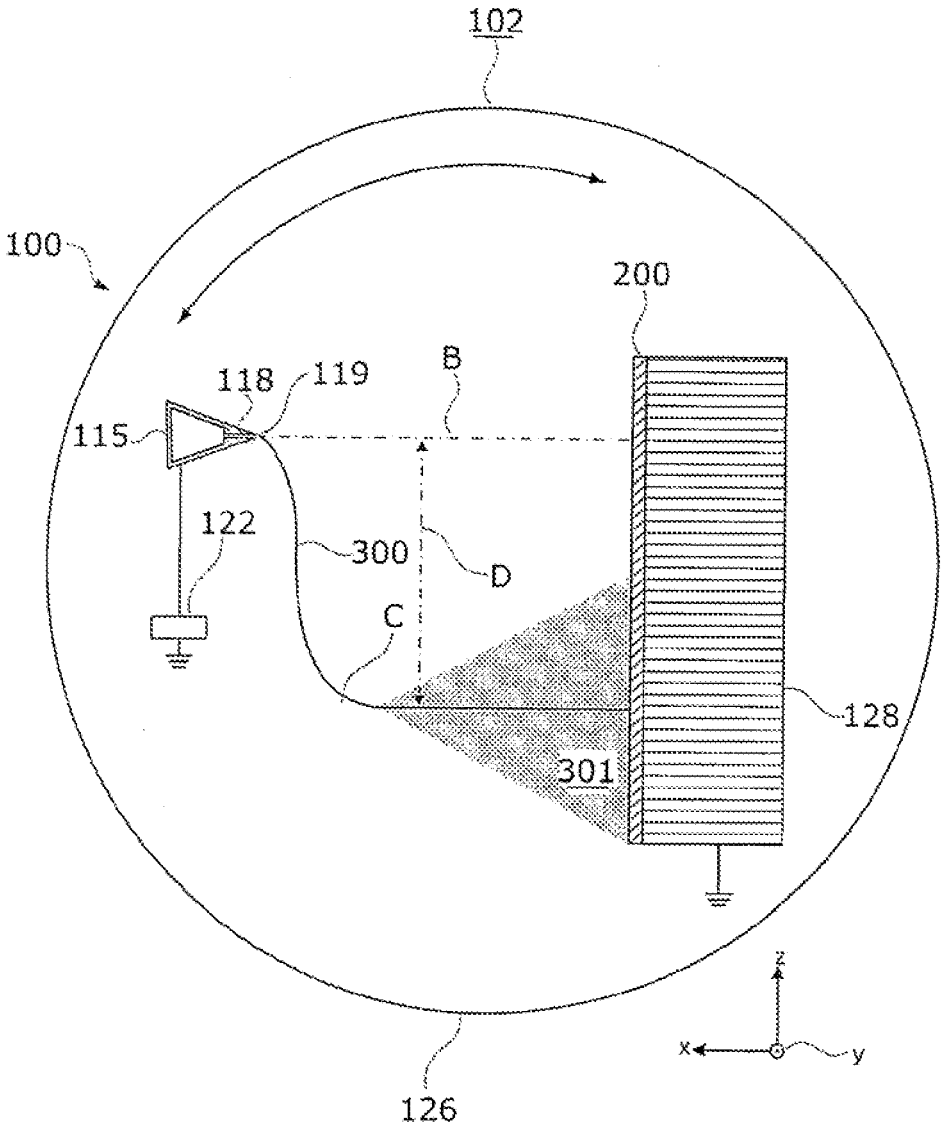
FIG. 7 is a side view illustrating a cross section of a main part of a nanofiber manufacturing apparatus to show another determining unit.

FIG. 7 is a side view illustrating a cross section of a main part of a nanofiber manufacturing apparatus to show another determining unit.

The determining unit 102 includes a position determining unit 126 which determines relative positions of the effusing body 115 and the charging electrode 128 such that the shortest imaginary path connecting the end openings 119 of the effusing holes 118 and the accumulation part A (the charging electrode 128) crosses the vertical direction (the z-axis direction in FIG. 7) at an angle. In this embodiment, the position determining unit 126 is a disc rotatable in the directions of the arrows in FIG. 7, and the effusing body 115 and the charging electrode 128 are installed so as to protrude from the position determining unit 126 in the y-axis direction in FIG. 7 (the direction perpendicular to the plane of the drawing). The position determining unit 126 is rotated and fixed in a certain position and a certain orientation so that the relative positions of the effusing body 115 and the charging electrode 128, that is, an angle of the direction of the charging electrode 128 viewed from the effusing body 115 with respect to the vertical direction, are perpendicular.

The position determining unit 126 is not limited to a disc and may have any shape as long as the position determining unit 126 can function as described above.

In this configuration, the solution 300 is caused to fly with the influence of gravity acting in a direction crossing the direction of action of attraction due to an electric field generated between the effusing body 115 and the charging electrode 128. In addition, the flight path of the solution 300 and the nanofibers 301 can be determined by changing the relative positions of the effusing body 115 and the charging electrode 128. Thereby the time for evaporation of the solvent from the solution 300 is prolonged by the time corresponding to the set length D without changing the shortest path length B between the effusing body 115 and the charging electrode 128. As a result, the probability of occurrence of electrostatic stretching is increased and the quality of nanofibers 301 can be improved.

Figure 8:
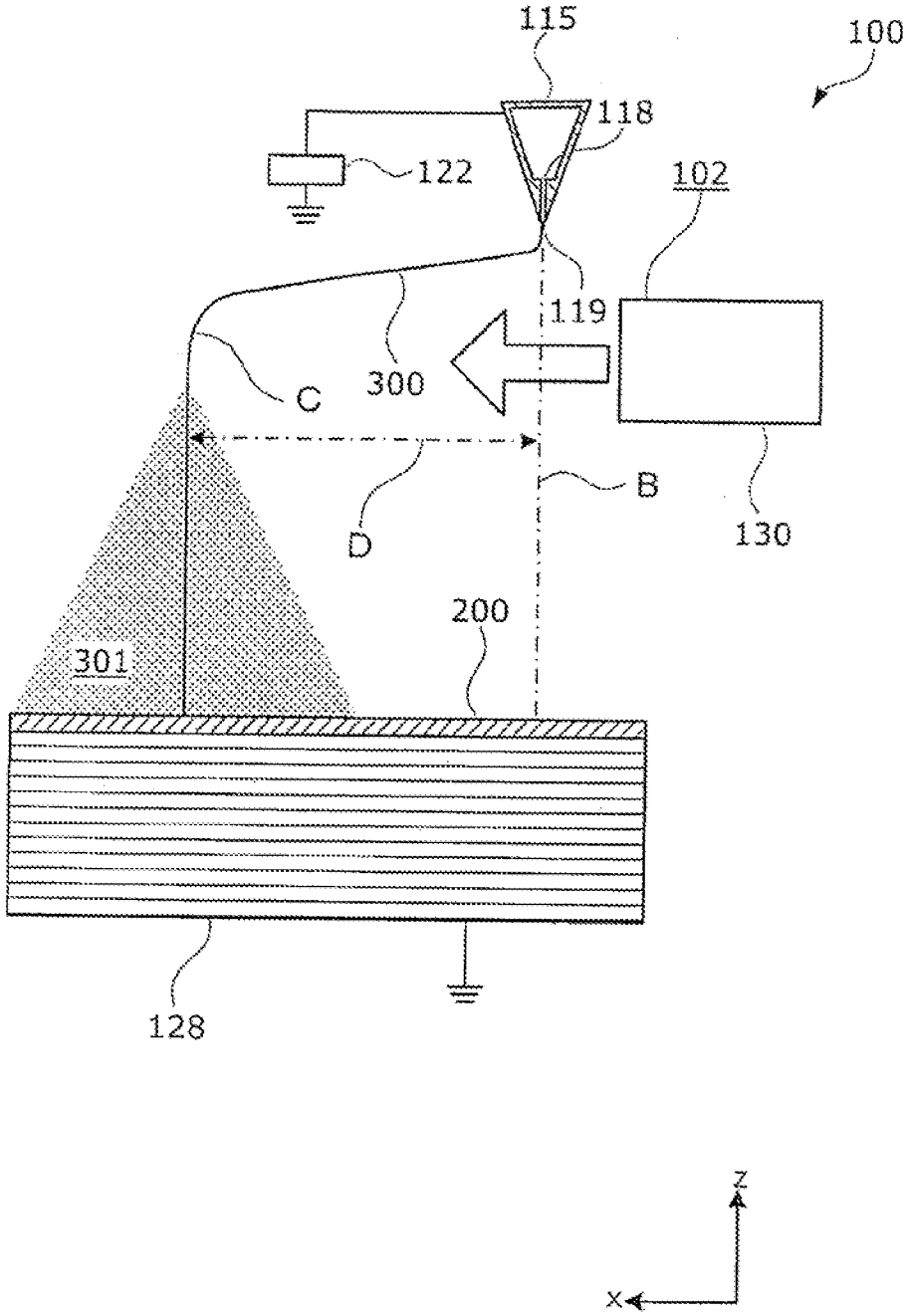
FIG. 8 is a side view illustrating a cross section of a main part of a nanofiber manufacturing apparatus to show another determining unit.

FIG. 8 is a side view illustrating a cross section of a main part of a nanofiber manufacturing apparatus to show another determining unit.

The determining unit 102 includes a gas flow generating unit 130 which generates a gas flow in a direction crossing the shortest imaginary path connecting the end openings 119 of the effusing holes 118 and the accumulation part A (the charging electrode 128), enabling determination of a flight path of the solution 300 and the nanofibers 301.

In this embodiment, the gas flow generating unit 130 includes an axial flow fan or a sirocco fan so that the gas flow generating unit 130 can collect ambient gas, that is, air and blow the air in a direction at a given pressure.

In this configuration, the solution 300 is caused to fly with the influence of gas flow generated by the gas flow generating unit 130 and acting in the direction crossing the direction of action of attraction due to an electric field generated between the effusing body 115 and the charging electrode 128. In addition, the flight path of the solution 300 and the nanofibers 301 can be determined by changing the installation position of the gas flow generating unit 130 or the pressure of the gas flow. Thereby, the time for evaporation of the solvent from the solution 300 is prolonged by the time corresponding to the set length D without changing the shortest path length B between the effusing body 115 and the charging electrode 128. As a result, the probability of occurrence of electrostatic stretching is increased and the quality of nanofibers 301 can be improved.

The gas flow generating unit 130 is not limited to a unit which transfers air at a pressure using a fan, and may be a unit which generates a gas flow by discharging air stored in a tank at a high pressure. The gas is not limited to air, and superheated steam or an inactive gas such as nitrogen may be used instead of air. In addition, the determining unit 102 may include a heating unit which raises the temperature of the gas flow. Use of gas flow for determination of the flight path of the solution 300 and the nanofibers 301 may produce an effect of promoting solvent evaporation by air flow in addition to the prolongation of the time for solvent evaporation from the solution 300 by the time corresponding to the set length D. Furthermore, the effect of promoting evaporation may be further increased by raising the temperature of the gas flow.

Figure 9:
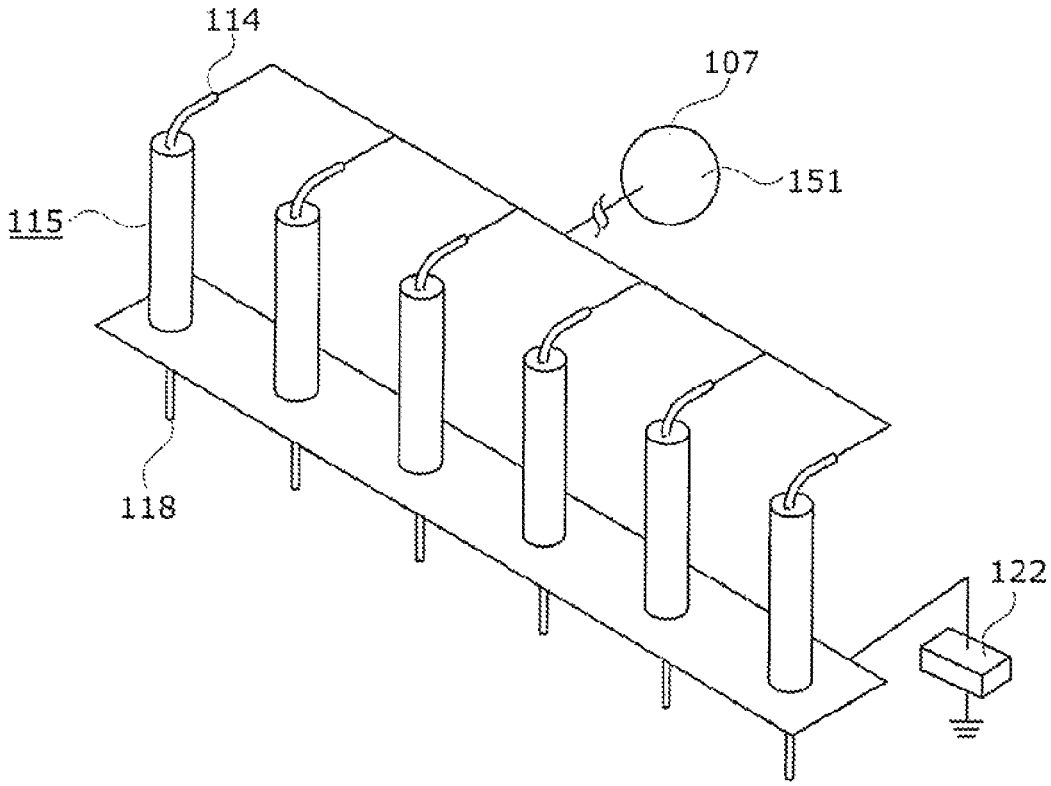
FIG. 9 is a perspective view illustrating another embodiment of the effusing body.

It is to be noted that present invention is not limited to the above embodiments. Embodiments including combinations of any of the above components in the above embodiments are within the scope of the present invention. Any variations of the present embodiment to be conceived by those skilled in the art without departing from the spirit of the present invention are also within the scope of the present invention. For example, the nanofiber manufacturing apparatus 100 may include an effusing body 115 in which a plurality of nozzles are arranged in line as shown in FIG. 9. Alternatively, the effusing body 115 may have only a single nozzle.

Figure 10:
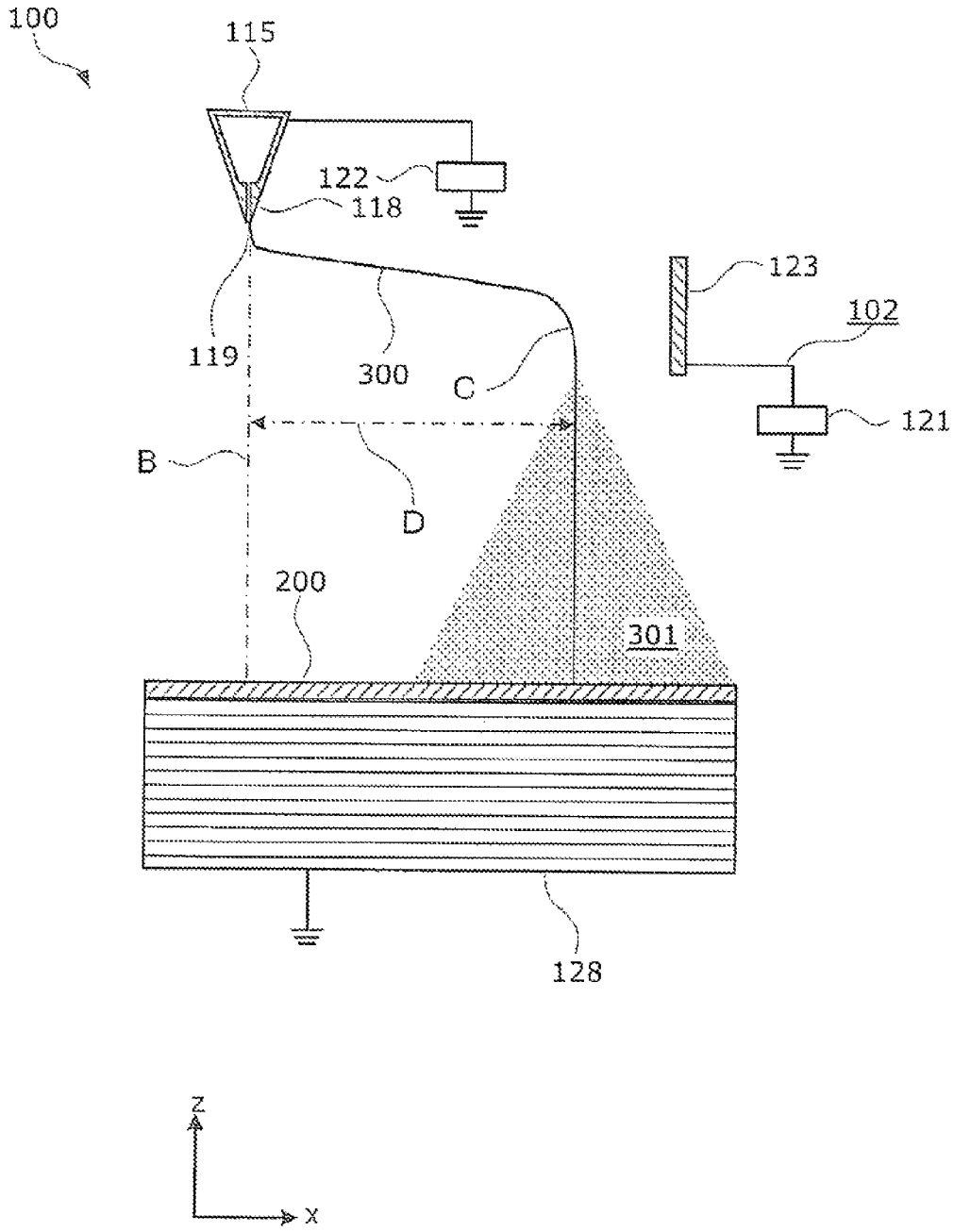
FIG. 10 is a side view illustrating a cross section of a main part of the nanofiber manufacturing apparatus according to another embodiment.

In addition, the determining unit 102 may determine a flight path by attracting the solution 300 and the nanofibers 301 by an electric field so that the flight path length C of the solution 300 and the nanofibers 301 is longer than the shortest path length B as shown in FIG. 10. Specifically, the charged solution 300 and nanofibers 301 are attracted to a certain degree to change the flight path. Then, the applying unit 121 applies a potential to the determining electrode 123 such that the determining electrode 123 has a polarity opposite to the polarity of the solution 300 and the nanofibers 301 in order to cause the nanofibers 301 to finally arrive at the deposition member 200.

Figure 11:
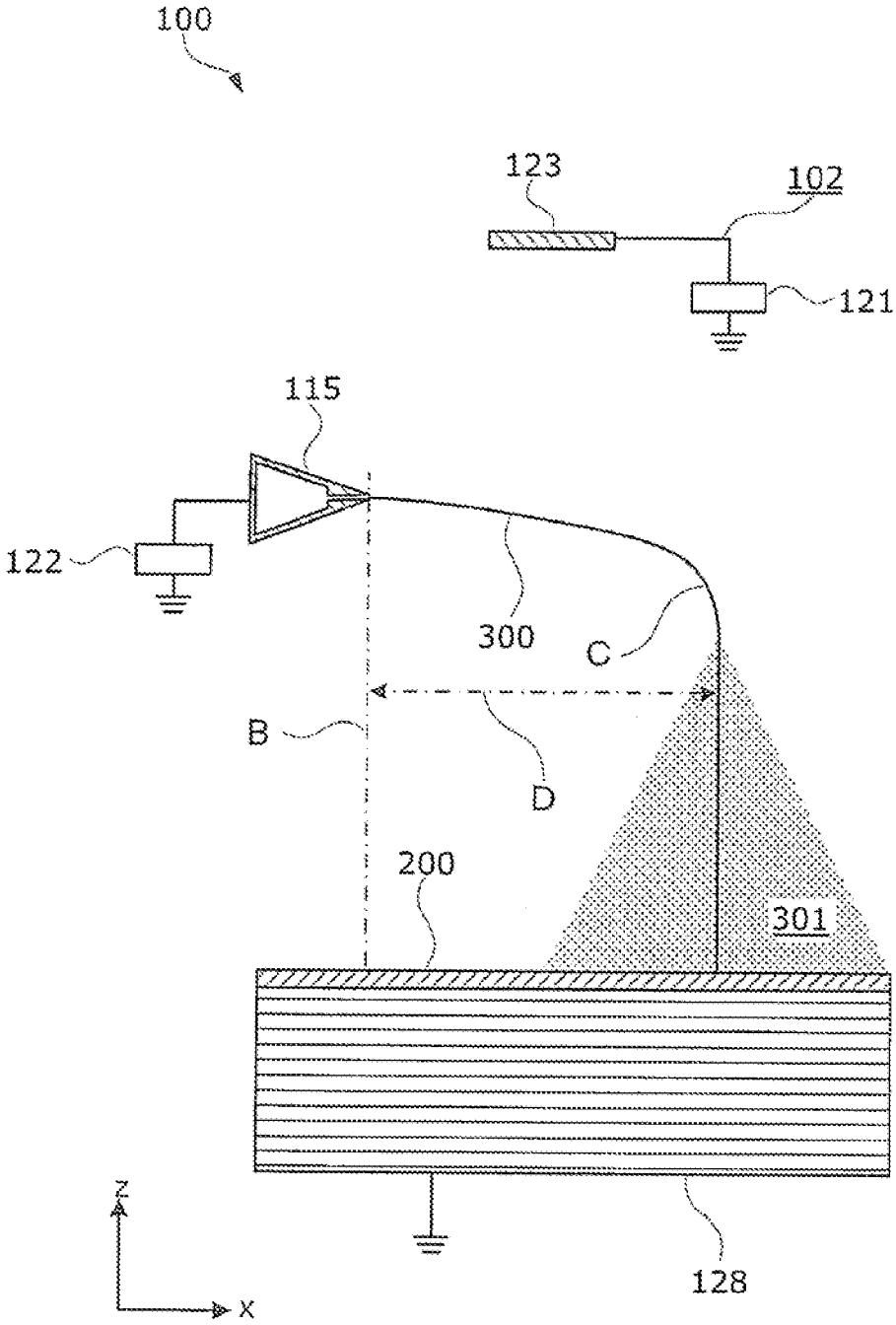
FIG. 11 is a side view illustrating a cross section of a main part of the nanofiber manufacturing apparatus according to another embodiment.

In addition, the effusing body 115 may be configured such that the solution 300 effuses from the effusing body 115 to between the charging electrode 128 and the determining electrode 123 as shown in FIG. 11. Specifically, the determining unit 102 may determine a flight path such that the flight path length C is longer than the shortest path length B, where the force acting on the solution 300 and the nanofibers 301 in the direction toward the charging electrode 128 is stronger than the force acting on the solution 300 and the nanofibers 301 in the direction toward the determining electrode 123 in somewhere on the flight path of the solution 300 and the nanofibers 301. Referring to FIG. 11, the force causing the solution 300 and the nanofibers 301 to head for the charging electrode 128 is a net force of the force due to an electric field generated at the charging electrode 128 and the gravity. Therefore, the position of the determining electrode 123 of the determining unit 102 or the potential to be applied to the determining electrode 123 should be set such that forces acting on the solution 300 and the nanofibers 301 are weaker than the net force.

FIG. 11 shows a preferable implementation in which the solution 300 is horizontally effused from the effusing body 115. However, the direction of the effusion of the solution 300 from the effusing body 115 is not limited to this and may be downward.

Embodiment 2

The following describes another embodiment of the present invention. In the following, the members having the same functions as the members in Embodiment 1 are denoted with the same reference numerals and the description thereof may be omitted.

Figure 12:
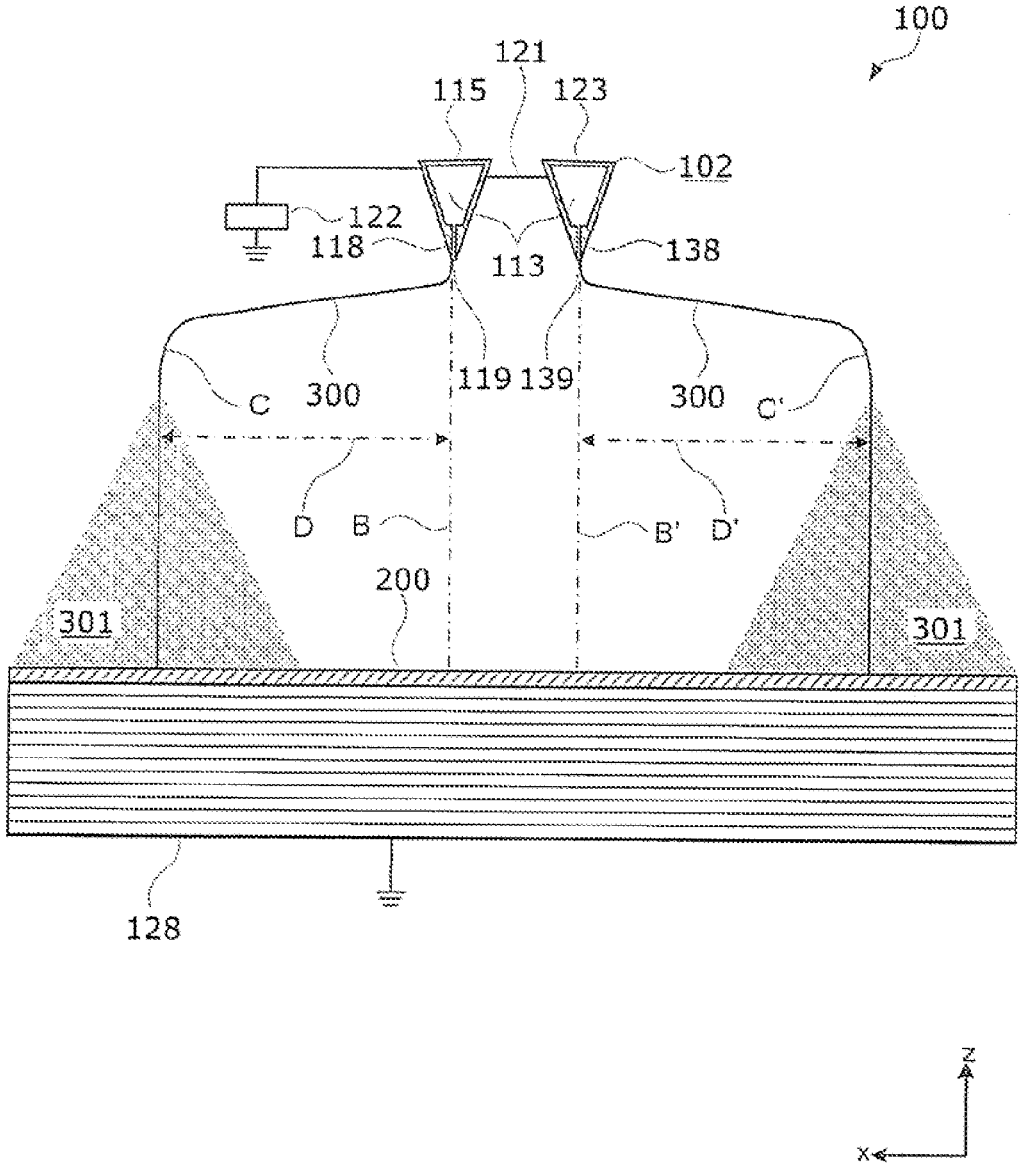
FIG. 12 is a side view illustrating a cross section of a main part of the nanofiber manufacturing apparatus according to another embodiment.

FIG. 12 is a side view illustrating a cross section of a main part of the nanofiber manufacturing apparatus.

A nanofiber manufacturing apparatus 100 includes an effusing body 115, a charging electrode 128, a charging power supply 122, a determining unit 102, and a deposition member 200 as shown in FIG. 12.

The determining unit 102 includes a determining electrode 123 and an applying unit 121.

The determining electrode 123 has the same shape as the effusing body 115 and is a conductive member connected such that the determining electrode 123 is at the same potential as the effusing body 115. In Embodiment 2, the determining electrode 123 is disposed at a given distance from the effusing body 115 and is at the same elevation as the effusing body 115.

In Embodiment 2, the determining electrode 123 also functions as a member which effuses the solution 300 into space by pressure of the solution 300 (and gravity in some cases) and has effusing holes 118 and a storage tank 113 in the same manner as the effusing body 115. In addition, the determining electrode 123 is made of metal in whole so as to function also as an electrode to provide charges to the solution 300 which effuses from the determining electrode 123.

The determining electrode 123 has a plurality of effusing holes 138. The effusing holes 138 are provided in an elongated, strip-shaped face of the determining electrode 123 in a manner such that end openings 139 at the ends of the respective effusing holes 118 align. The effusing holes 138 of the determining electrode 123 allow the solution 300 to effuse through the different effusing holes 138 in the same direction with respect to the determining electrode 123.

The effusing body 115 and the determining electrode 123 may be each provided with only one effusing hole 118, 138, respectively.

The applying unit 121 is a lead wire electrically connecting the effusing body 115 and the determining electrode 123 so that the determining electrode 123 is set at the same potential as the effusing body 115.

In the above configuration, the determining electrode 123 functions as an effusing body. Focusing on the effusing body 115 of the nanofiber manufacturing apparatus 100 according to Embodiment 2, the determining electrode 123 is a member which determines a flight path of the solution 300 and the nanofibers 301 such that a flight path length C of the solution 300 and the nanofibers 301 is longer than a shortest path length B (by a set length D, for example) which is the length of the shortest imaginary path connecting the accumulation part A (the charging electrode 128) and any one of the end openings 119 of the effusing holes 118 of the effusing body 115. On the other hand, focusing on the determining electrode 123, the effusing body 115 functions as a member which determines a flight path of the solution 300 and the nanofibers 301 such that a flight path length C' of the solution 300 and the nanofibers 301 is longer than a shortest path length B' (by a set length D', for example) which is the length of the shortest imaginary path connecting the charging electrode 128 and any one of the end openings 139 of the effusing holes 138 of the determining electrode 123.

The nanofiber manufacturing apparatus 100 in this configuration produces the nanofibers 301 by effusing the solution 300 not only from the effusing body 115 but from the determining electrode 123. Furthermore, the nanofiber manufacturing apparatus 100 is still compact even with flight path lengths C and C', which are long enough to cause electrostatic stretching, and thereby favorable nanofibers 301 are produced in a large quantity.

It is to be noted that the effusing body 115 has a plurality of the effusing holes 118 arranged in line, so that the threads of the solution 300 effused from the adjacent effusing holes 118 electrically repel each other. However, the intervals between the adjacent effusing holes 118 are filled with the elongated, strip-shaped face (a tip part) as shown in FIG. 2, so that generation of ionic wind is reduced and the repulsive forces between the threads of solution 300 effused from the effusing body 115 are therefore reduced. However, ionic wind is generated between the effusing body 115 and the determining electrode 123 shown in FIG. 12 so that the repulsive forces between the solution 300 effusing from the effusing body 115 and the solution 300 effusing from the determining electrode 123 are so large that the solution 300 effusing from the effusing body 115 and the solution 300 effusing from the determining electrode 123 fly along paths running farther away from each other.

Figure 13:
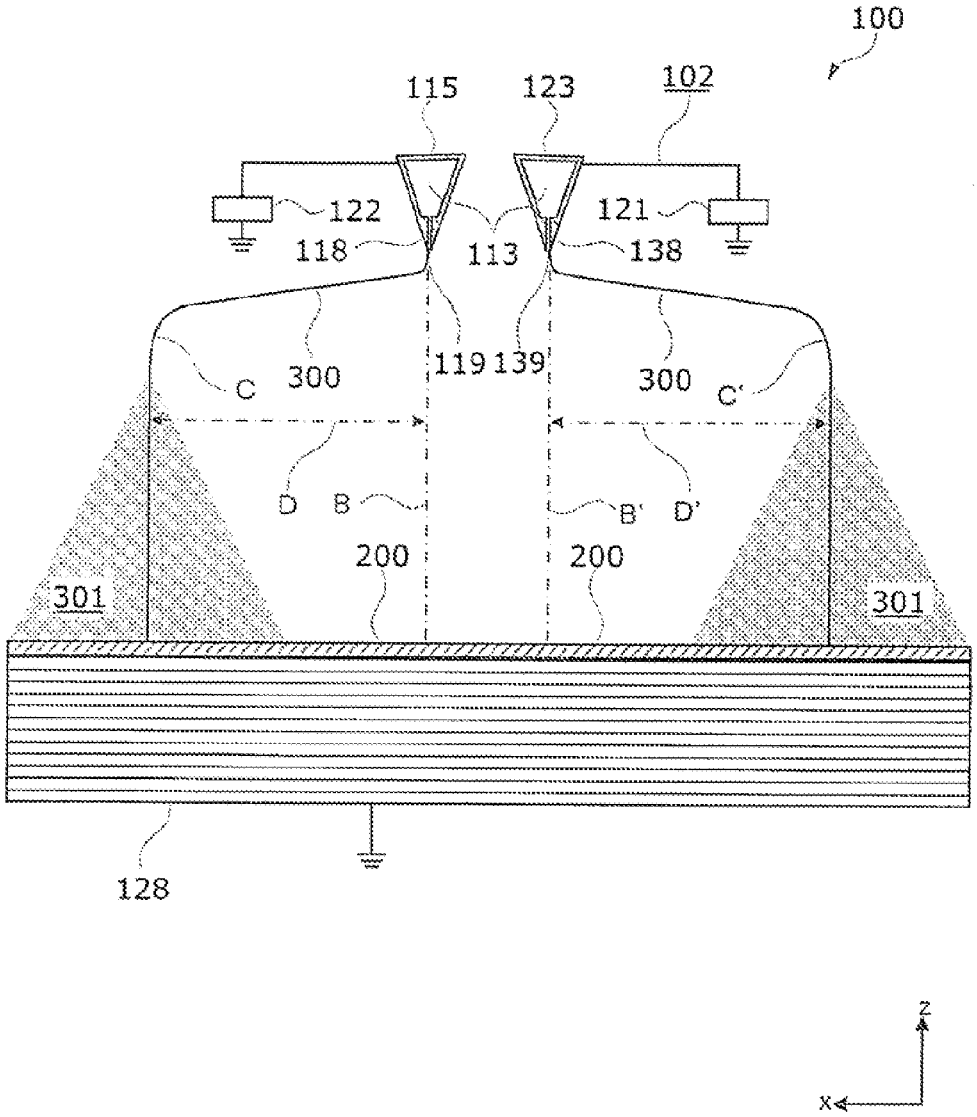
FIG. 13 is a side view illustrating a cross section of a main part of the nanofiber manufacturing apparatus according to another embodiment.

Optionally, the effusing body 115 and the determining electrode 123 may be electrically insulated as shown in FIG. 13 such that the applying unit 121 and the charging power supply 122 apply potentials to the effusing body 115 and the determining electrode 123, respectively, independently from each other.

The present invention is applicable to spinning using nanofibers or manufacturing of unwoven fabrics of nanofibers.

The invention claimed is:

1. A method of manufacturing nanofibers by electrically stretching a solution in space and depositing the nanofibers in a given region, said method comprising:

effusing the solution from an effusing body having an effusing hole which allows the solution to effuse in a direction;

applying a given voltage between the effusing body and a charging electrode which is conductive and disposed at a given distance from the effusing body, using a charging power supply configured to apply the given voltage;

comparing a required drying time and a reference time, the required drying time being a period of time from said effusing of the solution from the effusing body until generation of nanofibers by electrostatic stretching, and the reference time being a period of time of the flight of the solution or the nanofibers for a shortest path length which is a length of a shortest imaginary path connecting an end opening of the effusing hole and an accumulation part on which the nanofibers are accumulated;

calculating an additional flight time by subtracting the reference time from the required drying time when the reference time is shorter than the required drying time;

calculating a set length which is a distance of flight of the solution or the nanofibers for the additional flight time; and determining a flight path of the solution or the nanofibers using a total of the shortest path length and the set length as the flight path of the solution or the nanofibers.

* * * * *